United States Patent [19]

Keough

[11] 3,961,764

[45] June 8, 1976

[54] TOY SPACE VEHICLE PAYLOAD FOR A KITE

[75] Inventor: John E. Keough, Ogden, Utah

[73] Assignee: The Raymond Lee Organization, Inc., a part interest

[22] Filed: Oct. 25, 1974

[21] Appl. No.: 517,902

[52] U.S. Cl. ..... 244/155 R

[51] Int. Cl.[2] ..... A63H 27/08

[58] Field of Search ..... 244/155 R, 153 R, 33; D34/15 AF, 15 HR; 46/74 R, 77, 86 R; 294/82 R

[56] References Cited

UNITED STATES PATENTS

| | | | |
|---|---|---|---|
| 1,234,885 | 7/1917 | Dyer | 46/77 |
| 2,793,066 | 5/1957 | Rue | 294/82 R X |
| 2,950,887 | 8/1960 | Hidding | 244/155 R |
| 2,951,666 | 9/1960 | Wamsley | 244/155 R |
| 3,044,737 | 7/1962 | Vaura | 244/155 R |
| 3,848,835 | 11/1974 | Browning et al. | 244/155 R |

*Primary Examiner*—Trygve M. Blix
*Assistant Examiner*—Barry L. Kelmachter

[57] ABSTRACT

A toy comprising a component in the shape of a space vehicle and a carrier for this component is attached to the string of a kite which is being flown in a wind. The wind carries the carrier-component assembly up towards the kite along the string. At a predetermined point, the upward ascent of the carrier and its contents is halted by an obstruction placed on the kite string. This obstruction opens the carrier and causes it to release its contents, which descend to the ground under the influence of gravity. Attachments such as a guideline and a parachute may be attached to the released component. The guideline will prevent the component from being lost during its descent on a windy day while the parachute will aid in the ascent of the unit on a relatively calm day.

6 Claims, 7 Drawing Figures

TOY SPACE VEHICLE PAYLOAD FOR A KITE

SUMMARY OF THE INVENTION

My invention is a toy designed to be used in conjunction with a kite which is being flown in a wind.

Recent exploratory trips to outer space have caused excitement in children. It is the object of my invention to re-stimulate such excitement by simulating the landing of one of the spacecrafts used in such exploration.

To this end, I construct a toy consisting of a carrier and its payload, which can be shaped to simulate the form of a space ship. I use this carrier and payload in combination with a kite, which I fly in a wind some distance above the ground. I mount the carrier with its payload on the string of the kite, and let the wind carry the device up the kite string towards the kite. When the carrier reaches a predetermined point on the string, where I have previously placed an obstruction, the carrier is automatically opened and its payload released. The payload thus descends to the ground under the influence of gravity, the descent being slowed by the auto-gyro action of the turbine rotor thus simulating the landing of a spacecraft. In the case where I wish to insure the retrieval of the payload, I attach a guy line to the payload, the other end of the guy line is attached to the kite string in such a manner that the payload returns to the operator of the toy. I may also attach a parachute to the payload which will on a calm day aid in ascent of the vehicle and will also reduce the descent velocity.

DETAILED DESCRIPTION OF PREFERRED EMBODIMENTS

Figures 1, 2, 3, 4, 4A, 5, 6:
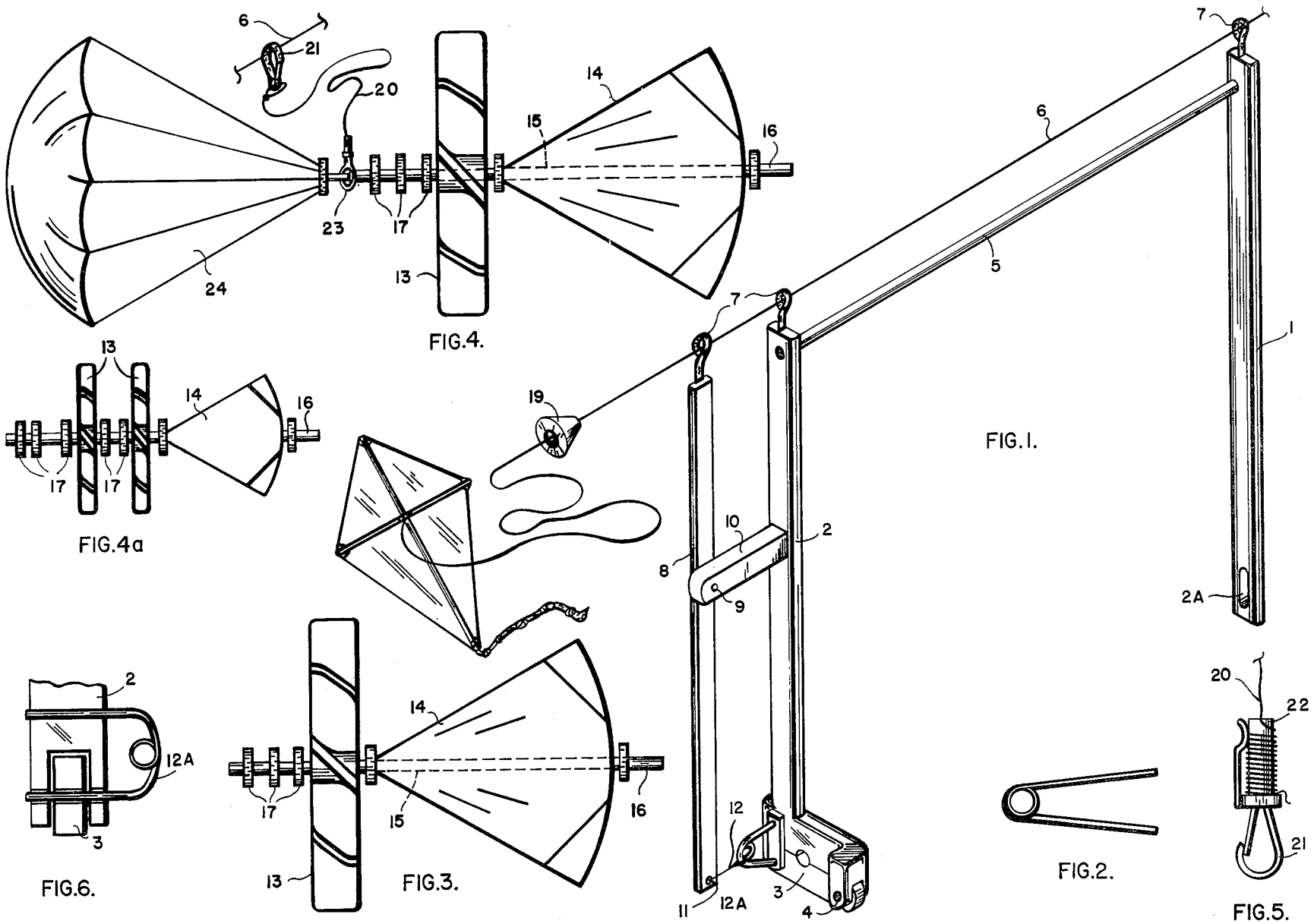
FIG. 1 is a perspective view of the carrier portion of my invention in use on a kite string.
FIG. 2 is a side view of a component of my invention.
FIG. 3 is a side view of the payload of my invention.
FIG. 4 is a side view of the payload of my invention, showing how two optional accessories may be attached.
FIG. 4A shows an additional rotor for optional use.
FIG. 5 is a side view of a feature of the retrieval accessory.
FIG. 6 is a detail view of the release jaw and release jaw spring.

Referring now to FIGS. 1–6, a carrier comprises rectangular payload support struts 1 and 2, the first of which bears a slot 2A and the second of which bears a notched release jaw 3 supported by a hinge 4, said struts connected by a connecting bar 5 and both attached to a kite string 6 by slide clips 7. The string is secured at one end to kite 25. A release mechanism comprising a sense bar 8 pivoted on a shaft 9 inset into a support bar 10 bears a slide clip as its upper end, and a hole 11 at its lower end, through which a wire 12 is passed, said wire being connected to a release jaw spring 12A. The payload, comprising a turbine rotor 13 and a hollow cone 14 both bearing mounted and allowed to freely rotate about axle 15 which bears a weighted support pin 16 at the end of the axle nearest the hollow cone and a series of discs or bearings 17 at the other, is mounted in the carrier with the support pin in the slot of the carrier and a section of the axle inbetween the discs or bearings in the notched section of the release jaw. When the wind propels the carrier with its payload up the kite string, at some predetermined point the sense bar is rocked back on its shaft by the action of a stop 19 placed on the string. This rocking withdraws the release jaw spring from the release jaw thus permitting the jaw to pivot to the open position. The disc bearing end of the payload is thus released, the capsule end of the axle will thus slip from the slot and the payload will descend to the ground capsule end first, the descent being restrained by the auto-gyro action of the turbine blades. The carrier is then, by the influence of gravity free to return down the kite string to the operator in preparation for another launch of the payload.

In the case where it is desirable, a guy line 20 is attached to the kite string by a slide clip 21 bearing a dowel 22 around which the line is wound with a wire catch, pressing down on the dowel and thus reducing the speed with which the line winds off the dowel. The other end of the guy line is attached to the payload at its disc bearing end by means of a ring 23 to which the line is attached. In addition, a parachute 24 is attached to the payload at its disc bearing end, said parachute will assist in accelerating the ascent of the payload on a calm day and will be an additional aid in slowing the descent of the payload to earth upon its release.

The payload can have an additional rotor located about one-half inch from the first rotor to provide increased efficiency.

While I have described my invention with particular reference to the drawings, such is not to be considered as limiting its actual scope.

Having thus described this invention, what is claimed and asserted as new is:

1. In combination with a kite having a string attached:

a payload shaped in the form of a space vehicle having a turbine rotor to aid in ascent and descent of the vehicle;

a carrier for said payload, said payload being detachably secured to said carrier, said carrier being attached to the string of said kite and bearing the payload upwardly towards the kite under the influence of the wind, said carrier including first and second rectangular payload support struts having slide clips at one end, said string extending slidably through said clips, and a connecting bar parallel to the string, said connecting bar extending transversely between said struts and secured at each end to the one end of the corresponding strut, the first strut having a longitudinally extending slot in the other end, the second strut having at its other end a notched release jaw supported in a hinge, said payload being supported by the notch in the jaw and by the slot in the first strut; and a stop mounted on the string which when touched by the carrier causes said playload to be released from the carrier and to descend to earth under the influence of gravity.

2. The combination of claim 1 wherein said carrier is provided with a carrier release mechanism actuated by contact with the stop, said mechanism including a release jaw spring secured to said jaw, a sense bar parallel to and spaced from the second strut, the sense bar having a slide clip at one end slidably engaging the string, an elongated support parallel to said connecting bar and interconnecting said second strut and said sense bar while extending transversely therebetween, said support being pivotally secured at one end to the sense bar at a point intermediate the ends of the sense bar, the sense bar having a hole in its opposite end and a wire extending through the sense bar hole and secured to said jaw spring, said spring normally biasing said notched jaw shut, but when the stop strikes the slide clip of the sense bar, causing the bar to pivot about the elongated support to pull the wire and to pull the spring out of the jaw, thus allowing the jaw to open and release the payload.

3. The combination of claim 2 wherein said payload includes a hollow cone and an axle, said cone and said rotor being freely rotatable on said axle, one end of the axle having a pin which engages the slot in the first strut when the payload is secured to the carrier, a section of said axle adjacent its other end being disposed in the notch in the jaw when the payload is secured to the carrier.

4. The combination of claim 3 wherein said axle has spaced discs on its other end, said section being disposed between adjacent discs.

5. The combination of claim 4 wherein a parachute is attached to the payload to aid in ascent in relatively calm wind.

6. The combination of claim 4 wherein a guy line is attached at one end to the payload and is slidably attached to the kite string at the other.

* * * * *